US008376245B2

(12) United States Patent
Ratnik et al.

(10) Patent No.: US 8,376,245 B2
(45) Date of Patent: Feb. 19, 2013

(54) SNOW MAKING APPARATUS AND METHOD

(75) Inventors: Heldur R. Ratnik, Pittsford, NY (US); Timothy C. Wang, Chili, NY (US); Matthew A. Carson, Lockport, NY (US)

(73) Assignee: Ratnik Industries, Inc., Victor, NY (US)

( * ) Notice: Subject to any disclaimer, the term of this patent is extended or adjusted under 35 U.S.C. 154(b) by 406 days.

(21) Appl. No.: 12/689,136

(22) Filed: Jan. 18, 2010

(65) Prior Publication Data

US 2011/0174895 A1 Jul. 21, 2011

(51) Int. Cl.
*F25C 3/04* (2006.01)

(52) U.S. Cl. ..... 239/14.2; 239/202

(58) Field of Classification Search ..... 239/14.2, 239/2.2, 568, 601, 548, 590.3
See application file for complete search history.

(56) References Cited

U.S. PATENT DOCUMENTS

| | | | | |
|---|---|---|---|---|
| 3,401,888 | A * | 9/1968 | Sutter | 239/568 |
| 3,829,013 | A | 8/1974 | Ratnik | |
| 4,480,788 | A * | 11/1984 | Manhart | 239/14.2 |
| 4,516,722 | A * | 5/1985 | Avery | 239/14.2 |
| 5,004,151 | A * | 4/1991 | Dupre | 239/2.2 |
| 5,031,832 | A | 7/1991 | Ratnik et al. | |
| 5,154,348 | A | 10/1992 | Ratnik et al. | |
| 5,884,841 | A | 3/1999 | Ratnik et al. | |
| 6,006,526 | A | 12/1999 | Nilsson | |
| 6,129,290 | A | 10/2000 | Nikkanen | |
| 6,508,412 | B1 * | 1/2003 | Pergay et al. | 239/14.2 |
| 6,543,699 | B1 | 4/2003 | Dupre | |
| 6,719,209 | B1 * | 4/2004 | Pergay et al. | 239/14.2 |
| 6,793,148 | B2 | 9/2004 | Ratnik | |
| 7,131,598 | B2 | 11/2006 | Ratnik | |
| 7,290,722 | B1 | 11/2007 | Ewald | |
| 2006/0079137 | A1 | 4/2006 | Rieder | |

* cited by examiner

*Primary Examiner* — Davis Hwu
(74) *Attorney, Agent, or Firm* — Woods Oviatt Gilman LLP; Katherine H. McGuire, Esq.

(57) ABSTRACT

A low energy snow making gun having at least one but preferably three operational stages each having at least one pair of small aperture water outlets which are oriented at a divergent angle to generate a respective pair of narrow angled water droplet streams which do not interfere with each other until they have reached a distance from the gun. A second pair of water outlets may be provided on each stage with each pair on each stage oriented at a divergent angle to maintain singularity of the streams over a distance thereby increasing the throwing power of the gun.

21 Claims, 11 Drawing Sheets

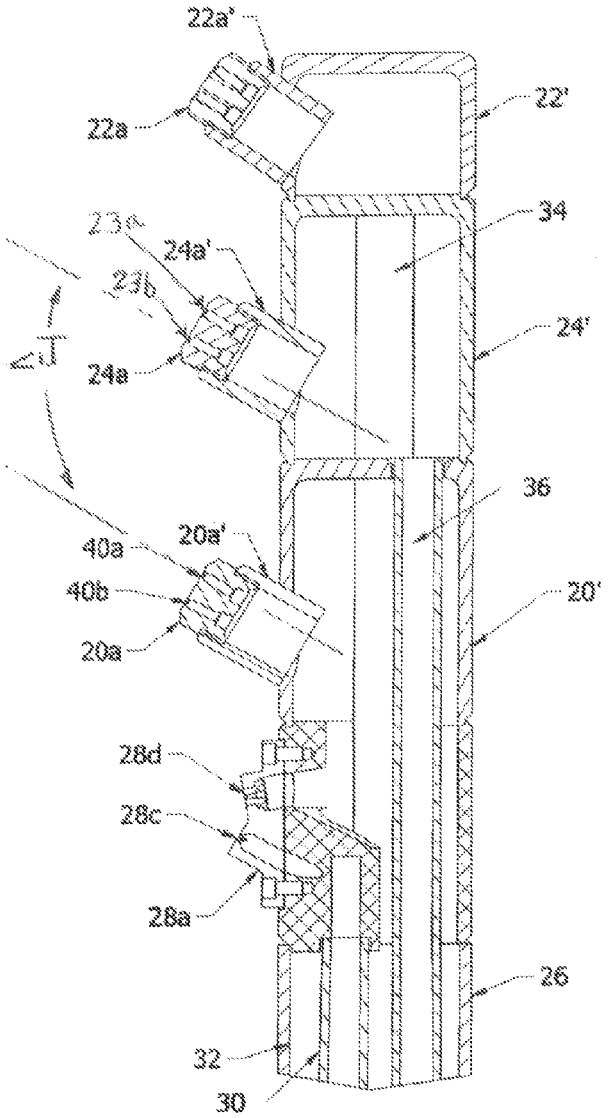
Fig. 7c
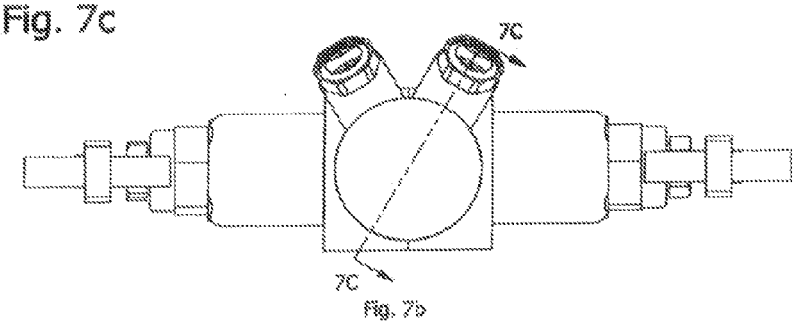

SNOW MAKING APPARATUS AND METHOD

BACKGROUND OF THE INVENTION

The present invention generally relates to methods and apparatus for making snow, and more particularly relates to a low energy snow making gun useful for making snow at ski resorts.

Snow making guns are known for making snow along ski slopes to maintain the slopes at their optimum condition for skiers. Snow guns operate by propelling water droplets into the air which collide with a plume generated by compressed air and atomized water whereupon the droplets form snow flakes that fall onto the slopes. Smaller snow guns which consume less energy than the large snow guns are more desirable as energy costs continue to rise. Prior art low energy guns have many problems including, for example, freezing of the components which have geometries allowing ice to collect on and in the gun, parts which are not easily removable and replaceable for servicing, limited snow throwing power due to a lack of controlled directionality and interference between the streams generated from the various nozzles, and low snow output as related to power consumption. For example, prior art snow guns use single nozzles each having large water outlet diameters which converge their output streams very close to the gun. This causes the streams to immediately lose momentum and directionality. There therefore remains a need for an improved low energy snow making gun which addresses the drawbacks of the prior art.

SUMMARY OF THE INVENTION

The present invention addresses the above need by providing in a low energy consumption snow making gun and method. In one aspect, the snow gun includes components having low profiles and spacing which discourages ice formation thereon. In another aspect, the snow gun includes improved valve configuration and operation of the individual stages. In yet another aspect, the snow gun water outlets are configured, sized, spaced and angled in a manner creating individualized water droplet streams which do not interfere with each other until they have traveled a distance from the snow gun. This allows the individual water droplet streams to maintain maximum momentum before they converge and form a single plume of snow propelled in one controlled direction. Each water outlet may be provided on a single nozzle although in a preferred embodiment, at least two water outlets are provided on a single nozzle. The size of the water outlets are small and generate a narrow angled V-shaped plume compared to typical prior art water outlets and the flow capacity of one pair of water outlets in the present invention may total a single larger water outlet of the prior art. Through proper spacing and directional orientation of the smaller water outlets, the present invention achieves improved snow throwing power than is attainable with prior art low energy snow guns.

It is understood that references to positional orientation such as "horizontal", "vertical", upper, lower, etc. as used herein is generally meant in relation to earth unless otherwise specified or readily understood from such words in connection with reference to the drawing.

The water nozzles may be made from a durable material such as stainless steel and include one or more small diameter outlet apertures which may be smaller on the pressure side of the nozzle opposite the exiting stream. In a preferred embodiment, a single nozzle includes at first and second water outlets arranged one above the other although it is understood that each water outlet may be formed on an individual nozzle. Also, although the invention is described and shown herein as having two outlets on a single nozzle head, more than two water outlets may be provided on a single nozzle head or stage. In a preferred embodiment, the snow gun includes at least one, but more preferably three individually operated snow making stages with at least two water outlets provided on each stage. Each vertically spaced pair of water outlets on each stage are oriented to diverge their respective water streams to prevent the stream from converging prematurely close to the gun. In the preferred embodiment, a second pair of water outlets is provided on each stage in annularly spaced relation to the first pair of water outlets for a total of four water outlets per stage. The first and second pairs of water outlets on each stage are oriented in a horizontally diverging manner, again to prevent premature convergence of the individual streams.

The snow gun includes a main water pipe or tube which lead to the nozzles. Water flowing through the main water tube and nozzles is above freezing temperature and heats the water tube and nozzle body to keep them body above freezing which discourages ice formation thereon.

A nucleator block is provided directly below a column of water outlets on the one or more stages and includes a water and air outlet for to atomize and project a plume of fine mist into the water droplet streams to form snow. The nucleator block may be formed of any suitable material such as brass or stainless steel which retains heat from the water flow and is low in profile which discourages ice formation thereon. The nucleator block is configured for easy and quick attachment and removal from the snow gun, e.g., by pair of screws extending through the block.

BRIEF DESCRIPTION OF THE DRAWING

FIG. 7*b* is a top plan view of the distal end of the snow gun of FIG. 1*a;*

FIG. 7*c* is a cross-sectional view as taken generally along the line 7*c*-7*c* of FIG. 7*b;*

DETAILED DESCRIPTION OF A PREFERRED EMBODIMENT

Figure 1A:
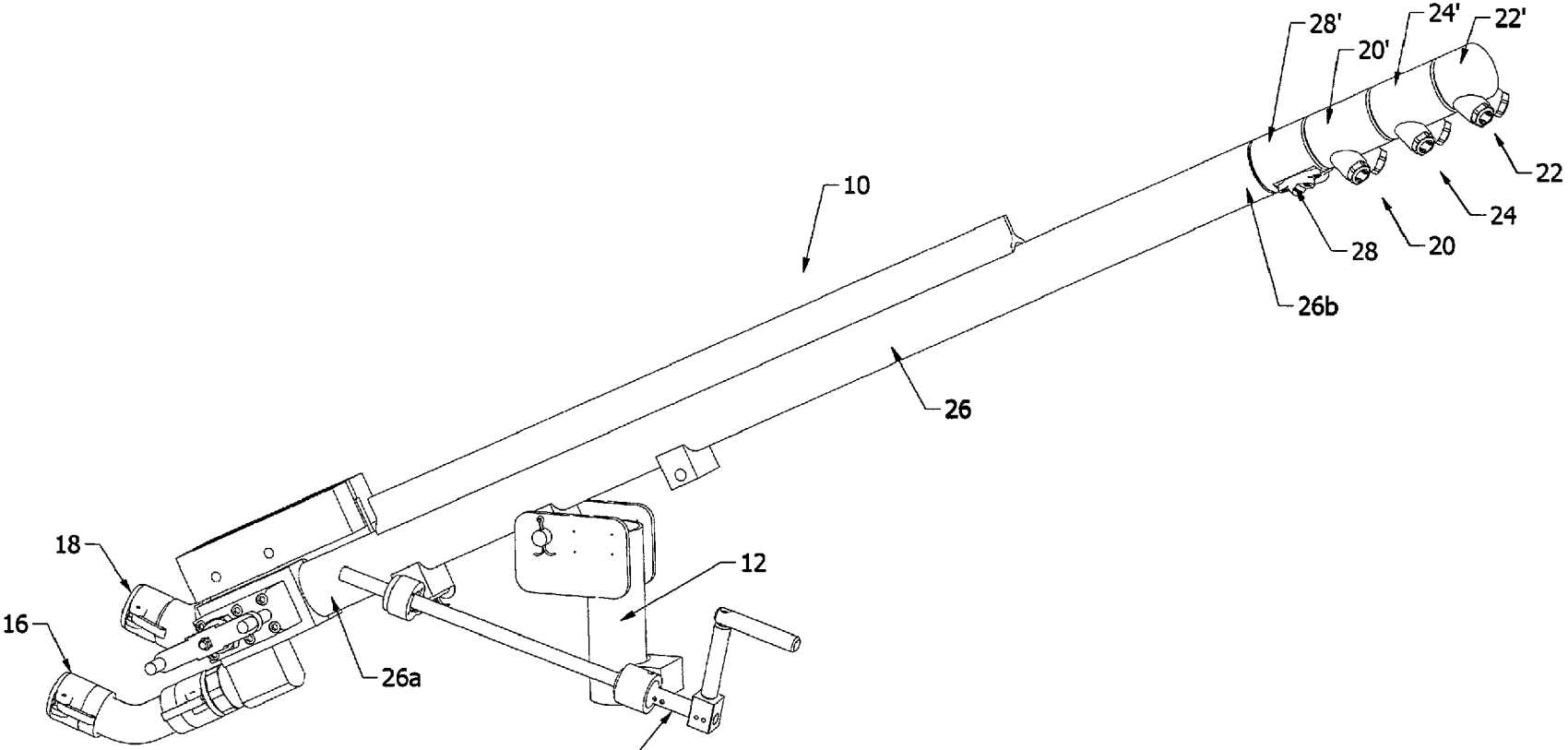
FIG. 1*a* is a perspective view of a snow gun according to an embodiment of the invention.
Figure 1B:
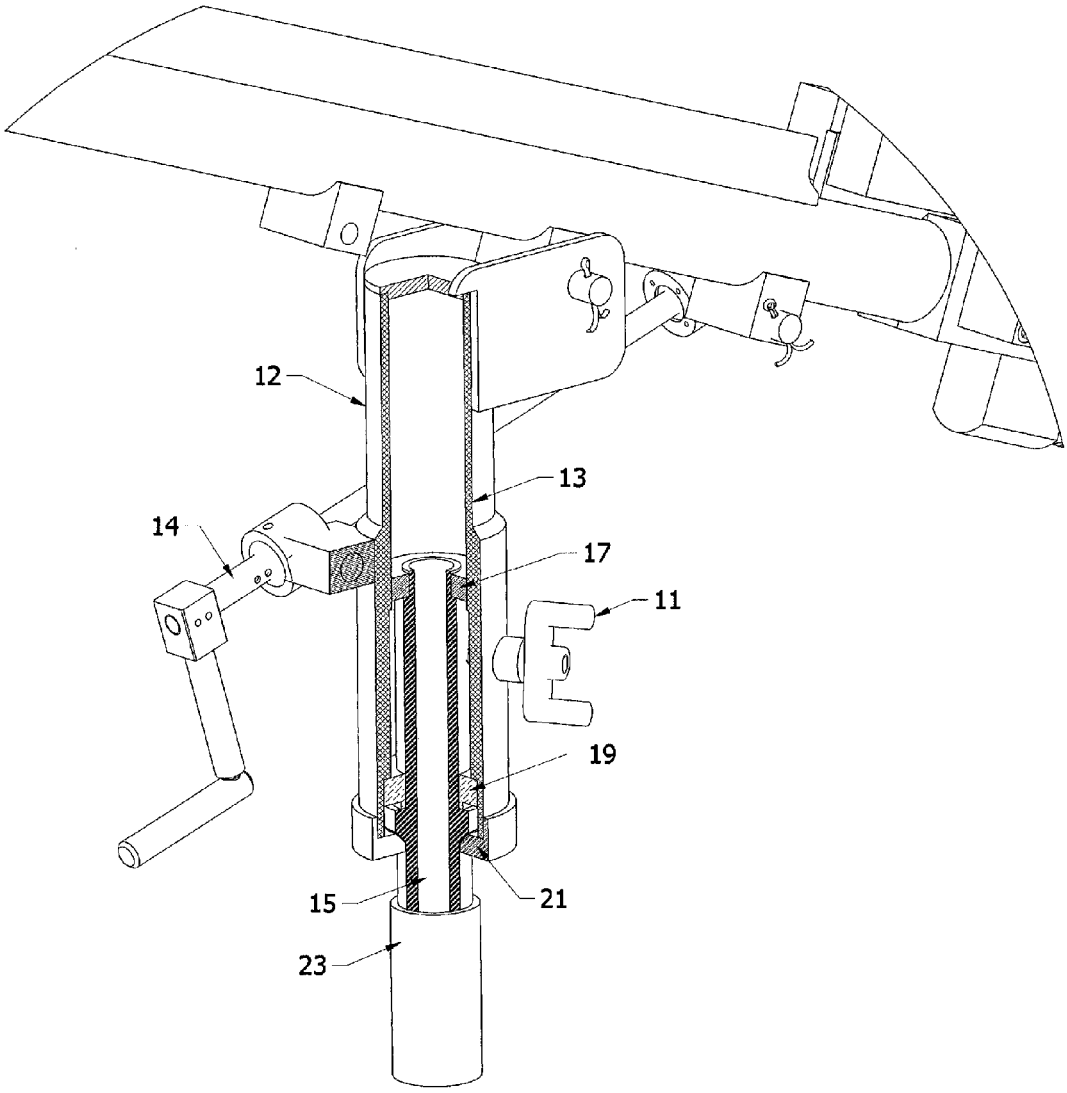
FIG. 1 *b* is a fragmented view partly in section showing an embodiment of an optional stand assembly to which the snow gun may be mounted.
Figure 3B:
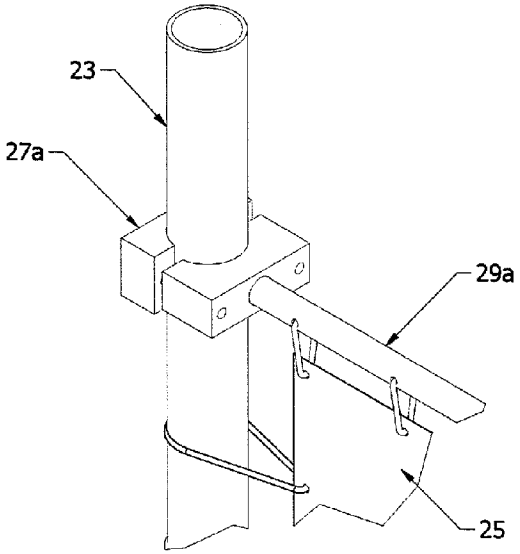
FIG. 3*b* is an enlarged, fragmented view of the detail portion "A" of FIG. 3*a;*
Figure 3A:
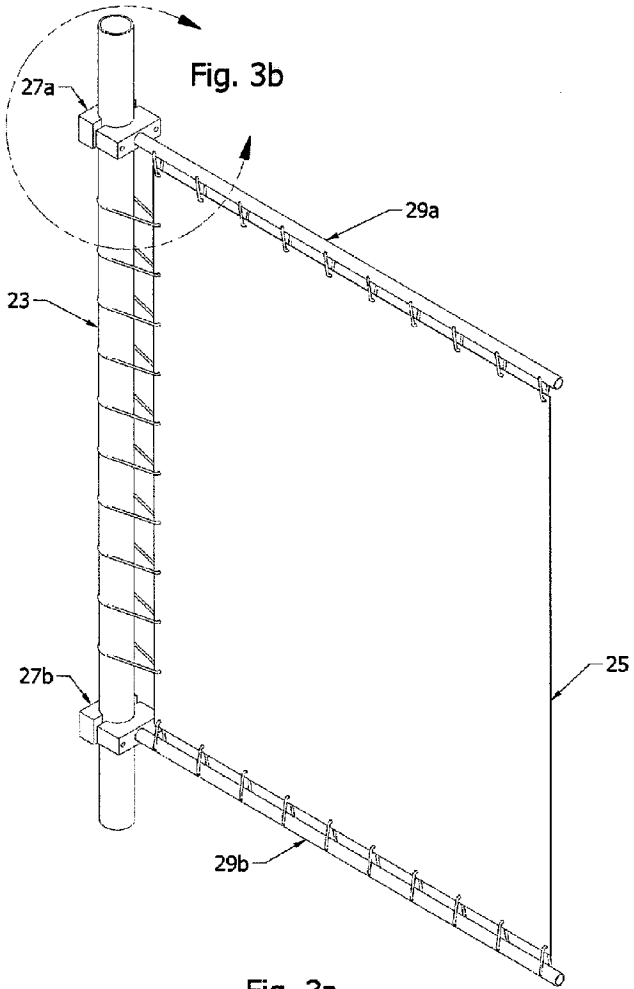
FIG. 3*a* is a perspective view of an optional sail assembly useful for use with the snow gun of the present invention.
Figure 4:
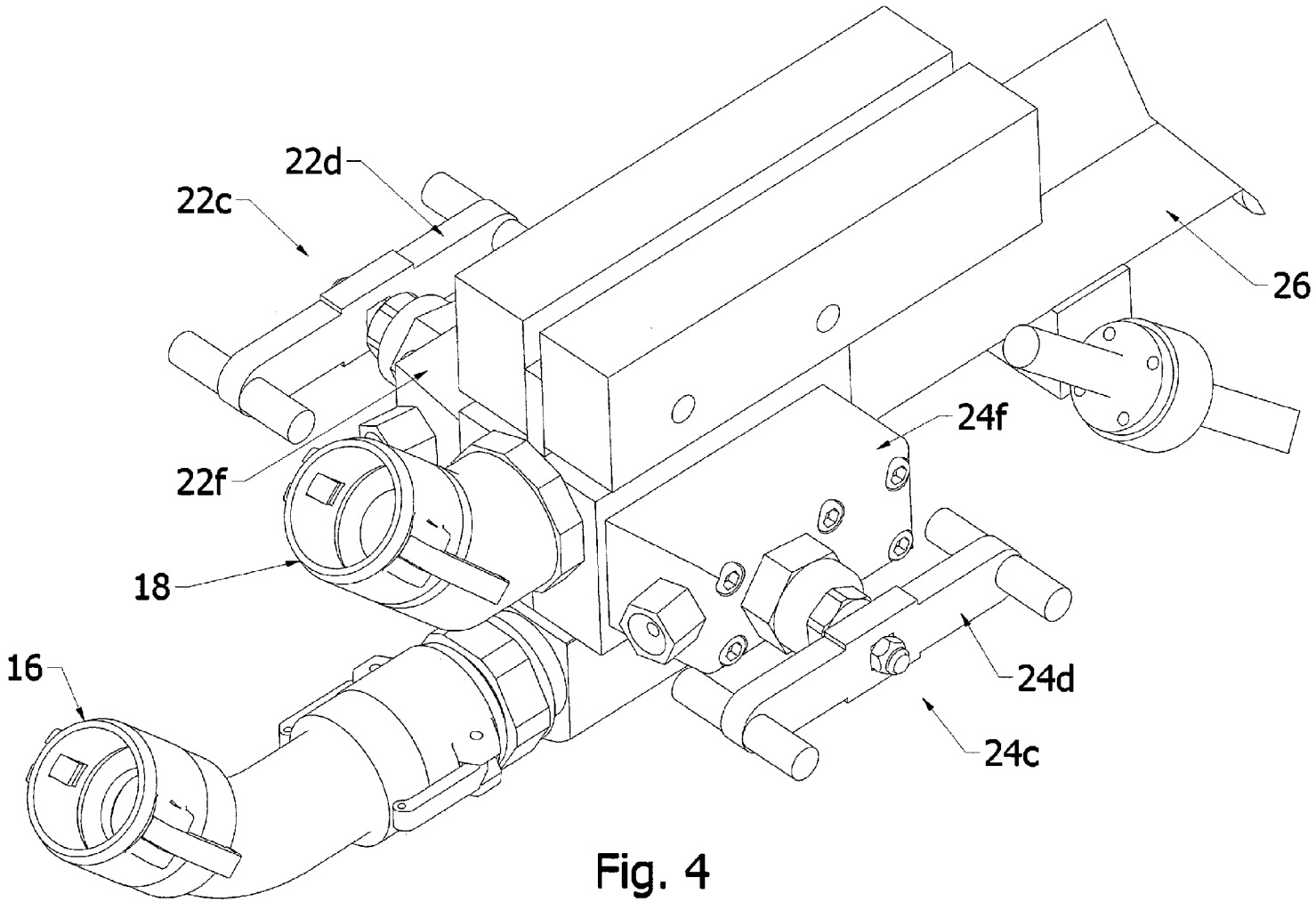
FIG. 4 is an enlarged, perspective view of the proximal end of the snow gun having the water and air inlet hook-ups.

Referring to the Drawing, there is seen in FIG. 1*a* a snow making gun designated generally by the reference numeral 10. Snow gun 10 includes a mounting stand 12 for pivotally mounting snow gun 10 to an appropriate ground post or sled at the ski slope (not shown). The height and angle of snow gun 10 may be adjusted via handle and jack screw assembly 14. For a snow gun that is not intended to pivot on a stand, a fixed stand 12 may be provided. For a snow gun that is meant to pivot, as seen in FIG. 1*b*, jack screw assembly 14 may be mounted to an outer casing 13 which may pivot about an inner shaft 15 via ball bearing 17 and thrust bearing 19. A locking cap 21 may be provided to removably secure inner shaft 15 into a tower stand 23 which itself may be in fixed position at the ski slope or mounted to a sled that may be transported to other locations. In one embodiment of the invention, an optional sail 25 seen in FIGS. 3*a* and 3*b* is provided for attaching to tower stand 23. Sail 25 may be of any suitable size and shape and is attached between a pair of spaced rods 29*a* and 29*b* which themselves are secured to tower stand 23 via adjustable clamps 27*a* and 27*b*, respectively. Sail 25 is operable to urge snow gun 10 to pivot in the direction of the prevailing winds about tower stand 23. This is beneficial in that it maximizes snow throwing potential and also discourages ice formation on the nozzles since the prevailing wind would be coming from behind the nozzles rather than at the nozzles. It is noted the maximum pivot angle is about 180 degrees although this may vary as desired. Also, to make the gun stationary, the gun may be locked in any desired position via locking handle 11.

Referring still to FIG. 1*a*, snow gun 10 includes a main water tube 26 extending between proximal and distal ends 26*a* and 26*b*, respectively, with a water inlet 16 and air inlet 18 provided adjacent proximal end 26*a* to which water and compressed air hoses (not shown) connect to deliver water and air under pressure to snow gun 10 in the manner to be described. Compressed air use may vary from about 42.0 CFM (1.2 Cubic meters per minute) at 90.0 PSI (6.3 Bar) at cold temperatures to about 87.0 CFM (2.5 Cubic meters per minute) at marginal temperatures. Of course minerals in the water supply and use of commercial snow inducers (e.g., SNOWMAX sold by YORK Snow Johnson Controls), and operating water pressure will affect results.

Figure 2:
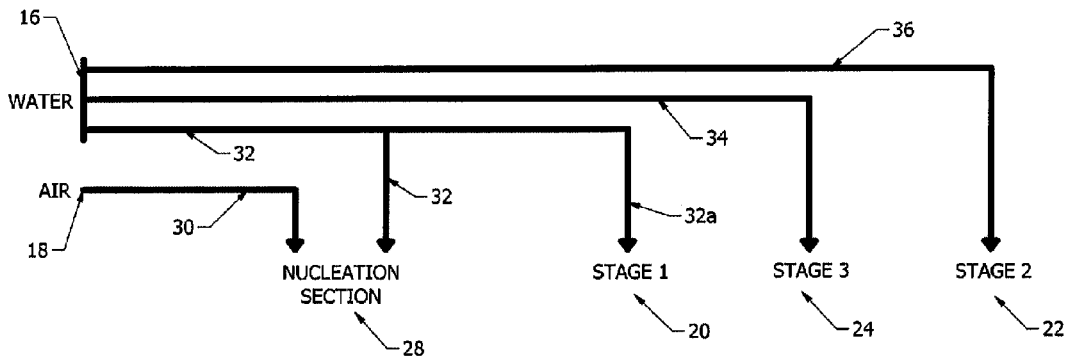
FIG. 2 is a schematic showing the water and air lines of the snow gun of FIG. 1*a;*

Snow gun 10 includes at least one, but more preferably includes first, second and third individual snow generation stages 20, 22 and 24 adjacent main tube distal end 26*b*, it being understood any number of stages may be provided on gun 10 as desired or required for a particular application. The snow generation process begins with water and air being delivered from water and air inlets 16 and 18 through main water tube 26 to nucleation section 28 via air conduit 30 and water conduit 32 (see FIG. 2). As seen best in FIGS. 7, 8 and 11*a*-*c*, at least one, but more preferably a pair of annularly spaced nucleation blocks 28*a* and 28*b* are provided on tube section 29 located at the distal end of main tube 26, each nucleation block including an air outlet 28*c* and water outlet 28*d* configured to atomize the water with the air outlet positioned below the water outlet and oriented to direct a plume of the atomized water droplets along a path which will intersect the trajectory of the slightly larger water droplets generated at first stage 20 and optionally second and third stages 22 and 24, respectively. When the path of the water droplets intersect the path of the atomized water plume from the nucleation block, snow is formed at ambient below freezing temperatures as is well understood by those skilled in the art of snow making.

Referring particularly to FIGS. 2 and 7-9, first snow generation stage 20 is seen to include at least one, but preferably a pair of water nozzles 20*a* and 20*b* removably mounted in respective nozzle holders 20*a*' and 20*b*' located on tube section 20' which extends from nucleation tube section 29. For embodiments having more than one stage, the pair of nozzles from one stage are in longitudinal alignment with the corresponding nozzles on an adjacent stage such that the nozzles form individual columns such as C1 and C2 seen in FIG. 7*a*.

Referring also to FIG. 7*c*, it will be appreciated that since the nozzle 24*a* of third stage 24' is longitudinally aligned with and extends at the same angle "E" as nozzle 40*a* on first stage 20', and since the first and second water outlets or each nozzle 24*a* and 40*a* are directed at vertically diverging angles "H", the first (upper-most) water outlet 40*a* of nozzle 40*a* and the second (lower-most) water outlet 23*b* of nozzle 24*a* are directed at a converging angle "J".

The water nozzles of the present invention are configured and oriented to generate and project an optimal plume of water droplets. More particularly, as seen best in FIGS. 10*a*-*f*, a representative water nozzle 20*a* of the present invention includes at least one, but preferably two or more water outlets 40*a* and 40*b* with first outlet 40*a* located above second outlet 40*b* when in operation on gun 10. Although the pair of water outlets 40*a* and 40*b* are optimally provided in a single nozzle head as shown in the figures, it is understood that the water outlets may be provided on individual nozzle heads. In a preferred embodiment, water outlets 40*a* and 40*b* are positioned at substantially the center of a respective, generally crescent-shaped concave area 40*a*' and 40*b*' which are formed in a substantially planar front face 40*c* having a tapered perimeter section 40*d* forming a low profile surface which discourages ice formation thereon. Nozzle annular base 40*f* may be shaped to be received in an optional respective nozzle holder 20*a*' (via a friction fit, snap fit or threaded engagement, for example) with an appropriately configured surface 40*e* provided to allow quick and easy attachment and removal of nozzle 20*a* to and from nozzle holder 20*a*' as needed either manually or with a tool.

It is envisioned nozzles of various sizes having one or more water outlets of varying diameters and shapes may be offered for snow gun 10 with Table 1 below providing several non-limiting examples of water to snow conversion rates at a psi of 360:

TABLE 1

| Nozzle Type | Water Outlet Diameter along horizontal plane "H" (FIG. 10c) | Water Outlet Diameter along vertical plane "V" (FIG. 10c) | GPM (gal. per min.) output | Water Pressure (psi) |
|---|---|---|---|---|
| Nozzle A | .066 | .106 | 6 | 360 |
| Nozzle B | .129 | .079 | 9 | 360 |
| Nozzle C | .138 | .094 | 12 | 360 |
| Nozzle D | .183 | .118 | 18 | 360 |

Figure 10D:
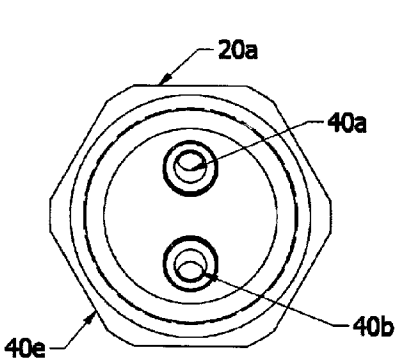
FIGS. 10*a-f* are top, side, front, rear, rear perspective and front perspective views of a water nozzle, respectively.
Figure 10F:
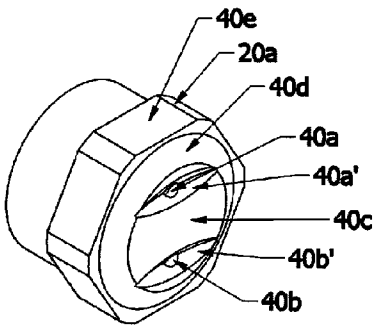
Figure 10C:
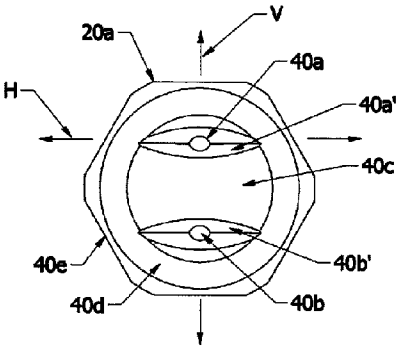
Figure 10E:
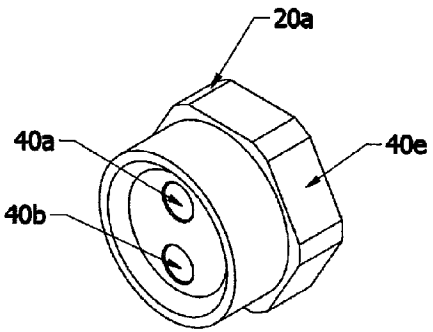
Figure 10A:
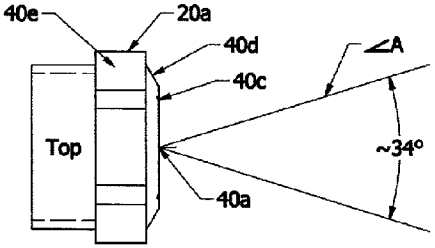
Figure 10B:
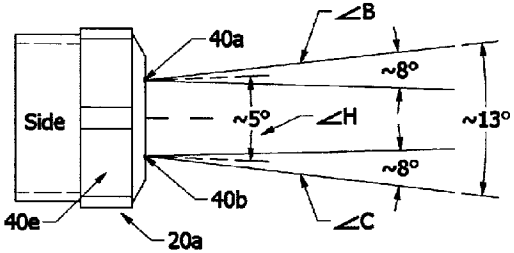
Figure 11A:
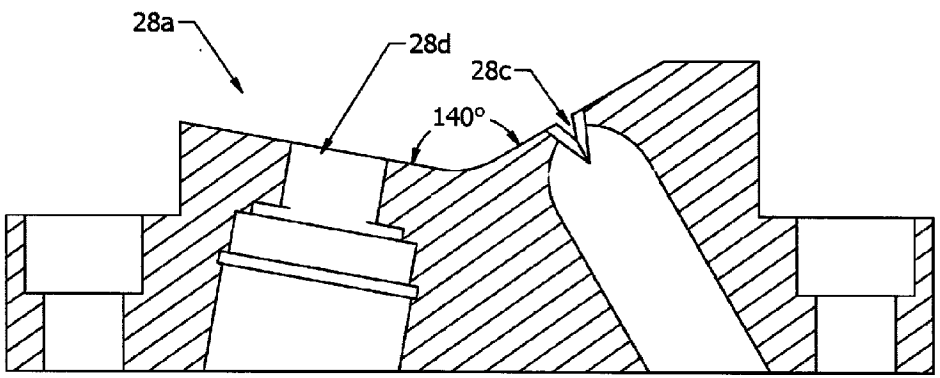
FIG. 11*a* is an enlarged, cross-sectional view of the nucleator block as taken generally through the line 11*a*-11*a* of FIG. 11*b;*
Figure 11C:
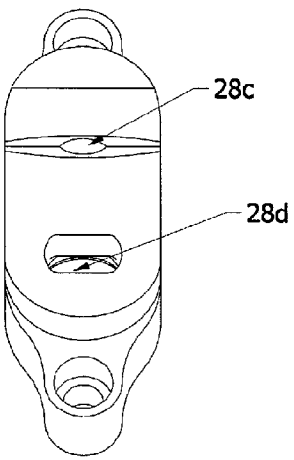
FIG. 11*c* is a reduced view of FIG. 11*b* rotated 180 degrees.
Figure 11B:
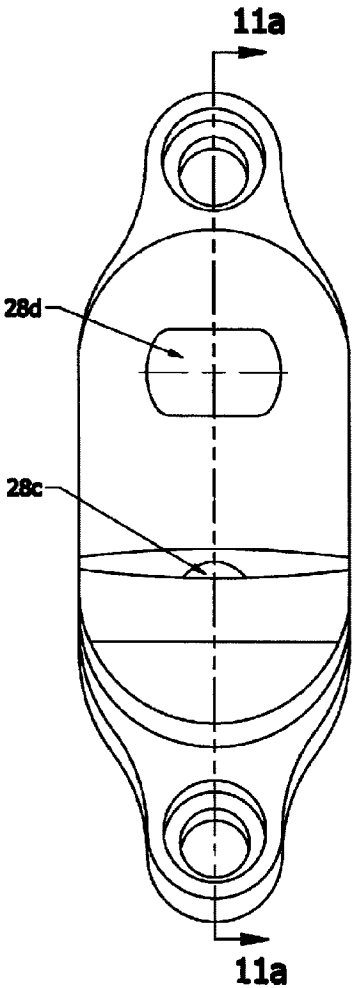
FIG. 11*b* is an enlarged front elevational view thereof.

Nozzles of the same or different type may be used on the various stages. The following provides several non-limiting examples of possible configurations:

Configuration 1:
Stage 1: Nozzle Type A
Stage 2: Nozzle Type B
Stage 3: Nozzle Type A
Configuration 2:
Stage 1: Nozzle Type B
Stage 2: Nozzle Type C
Stage 3: Nozzle Type B
Configuration 3 (in Very Cold Conditions):
Stage 1: Nozzle Type C
Stage 2: Nozzle Type D
Stage 3: Nozzle Type C FIGS. 10*a* and 10*b* illustrate the general paths along which the water droplets are projected from a nozzle. For purposes of description and not by way of limitation, although the generated water droplet plume is three dimensional in nature, relative to the ground, angle "A" depicted in the top view of FIG. 10*a* extends along a generally horizontal plane and angles "B" and "C" depicted in the side view of FIG. 10*b*. extend along generally vertical planes.

As seen in FIG. 10*a*, when viewed from above, each water outlet 40*a* and 40*b* project water droplets at an angle "A" of between about 25 to about 60 degrees, and more preferably between about 28 to about 40 degrees, and most preferably about 34 degrees. As seen in FIG. 10*b*, when viewed from the side, each water outlet 40*a* and 40*b* project water droplets at an angle "B" and "C" of between about 1 to about 15 degrees, and more preferably between about 6 to about 10 degrees, and most preferably about 8 degrees. Although in the preferred embodiment, angles "B" and "C" are substantially equal, it is envisioned that non-equal angles may be utilized if appropriate for a given application.

In the preferred embodiment, water outlets 40*a* and 40*b* are configured to diverge their respective output streams at an angle "H" of between about 0 to about 15 degrees, and more preferably between about 4 to about 6 degrees, and most preferably about 5 degrees. The angular span between the upper-most extent of the stream exiting outlet 40*a* and the lower-most extent of the stream exiting outlet 40*b* is between about 1 to about 30 degrees, and more preferably between about 11 to about 15 degrees, and most preferably about 13 degrees.

Figure 9:
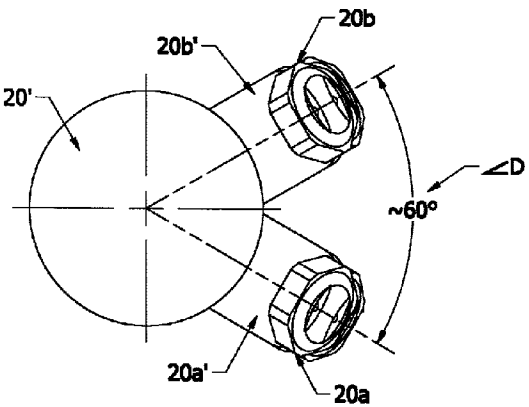
FIG. 9 is a top plan view of tube section 20' in FIG. 7.

As seen in FIG. 9, each pair of nozzles at each stage are preferably oriented to diverge at an angle "D" of between about 40 to about 80 degrees, and more preferably between about 50 to about 70 degrees, and most preferably about 60 degrees from each other.

Figure 7A:
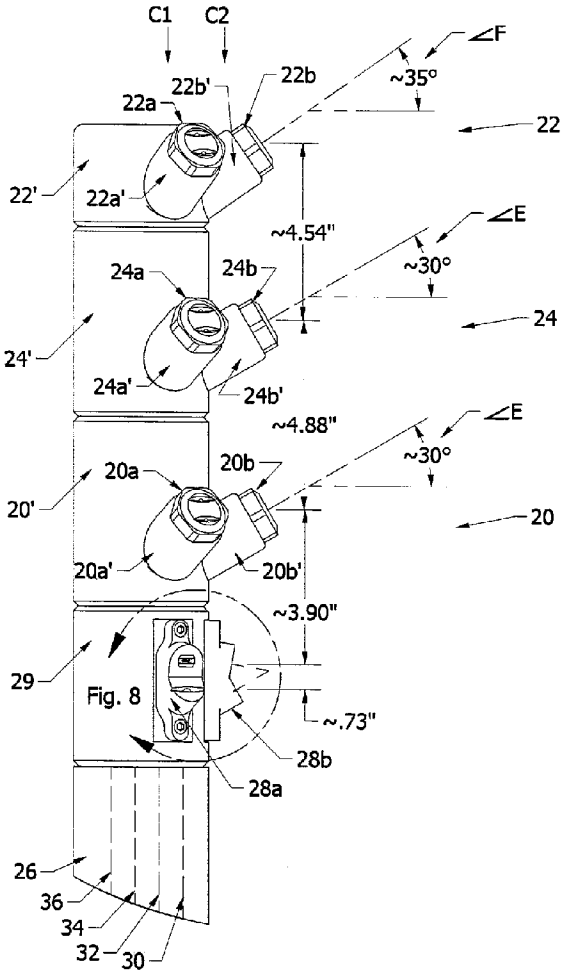
FIG. 7*a* is a side elevational view of the distal end of the snow gun of FIG. 1*a;*

As seen in FIG. 7*a*, each nozzle of first stage 20 and third stage 24 is oriented on and with respect to the surface of a respective tube section 20' and 24' at an upwardly directed angle "E" of between about 20 to about 40 degrees, and more preferably between about 28 to about 32 degrees, and most preferably about 30 degrees. Each nozzle of second stage 22 is oriented on a respective tube section 20' and 24' at an upwardly directed angle "F" of between about 25 to about 45 degrees, and more preferably between about 33 to about 37 degrees, and most preferably about 35 degrees.

Second stage 22 is intended to be operated after activation of first stage 20 while third stage 24, which may be located between first and second stages 20 and 22, is intended to be operated after activation of second stage 22. Operation of the various stages is generally dependent on the ambient temperature. For example, first stage 20 may be operated at about 30 F (−1.1 C) wet bulb temperature while activation of second stage 22 is typically begun at about 25 F (−3.89 C) wet bulb temperature and third stage 24 is typically begun at about 20 F (−6.67 C) wet bulb temperature.

As seen in FIG. 7*a*, the spacing between nucleator block and nozzles at each stage may be selected to further optimize the spacing of the streams. For example, and not by way of limitation, first stage 20 may be spaced a distance of about 3.90 inches from nucleator blocks 28*a,b* as measured from the centers of the water outlets. Also, third stage 24 may be spaced a distance of about 4.88 inches from first stage 20 and third stage 24 may be spaced a distance of about 4.54 inches from second stage 22.

Figure 8:
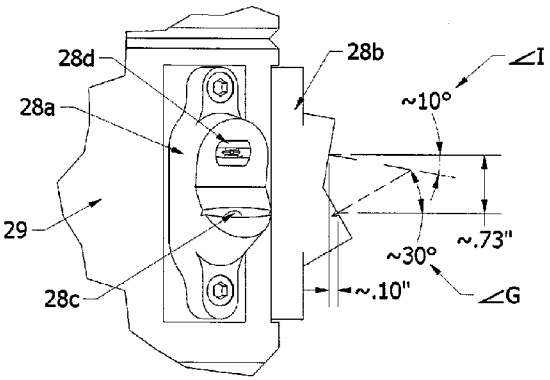
FIG. 8 is an enlarged, fragmented view of the detail portion "D" of FIG. 7.

As seen in FIG. 8, in each nucleation block 28*a*, 28*b*, air outlet 28*c* is oriented at an upwardly directed angle "G" of between about 20 to about 40 degrees, and more preferably between about 28 to about 32 degrees, and most preferably about 30 degrees, and water outlet 28*d* is oriented at a downwardly directed angle "I" of between about 0 to about 20 degrees, and more preferably between about 8 to about 12 degrees, and most preferably about 10 degrees. It is also noted that the first and second nucleation blocks are vertically aligned with a respective column of nozzles. As such, the water and air outlets of nucleation blocks 28*a* and 28*b* are oriented at a diverging angle substantially equal to angle "D" (see FIG. 9).

The above-described angularity among and between the various components and water and air streams of the low energy snow gun have been selected to provide optimum snow generation and throwing performance. In the preferred embodiment, the individual stream of water droplets projected from the nozzles do not interfere with each other in the area close to the gun. For example, as seen in FIG. 10*b*, the stream emanating from outlet 40*a* is spaced from the stream emanating from outlet 40*b*. At a point in the distance, these two stream will converge, but not until they have traveled a distance from the gun. This permits the individual streams to maintain maximum momentum allowing them to reach further across the slopes than prior art snow guns having streams which prematurely cross and interfere with each other closer to the snow gun. For example, the two streams from the water nozzles at each stage may converge at about between 10 inches to about 12 inches from snow gun 10; the first and second stages 20 and 22 streams may converge at between about 5 feet to about 6 feet from the snow gun 10; and the second and third stages 22 and 24 streams may converge at about 8 feet to about 10 feet from snow gun 10. Of course it is understood that the conversion distances may vary considerably depending on wind conditions since a tail wind will carry the streams further before converging while a head wind will force the streams together sooner.

The configuration of the nucleation block air outlet 28*c* and water outlet 28*d* is optimized to provide finely atomized water droplets which are propelled as a plume by the compressed air stream at a rate and angle which reaches the water droplets emanating from the nozzles at the most opportune location. For example, the nucleation plume may intersect the first stage 20 streams at approximately 3 feet from the snow gun 10.

Thus, through the proper selection of angles among the water droplet streams of the first, second and third stages, and between the nozzle columns C1 and C2, the individual water droplet streams are projected and maintain momentum as individualized streams until they converge at a distance from the snow gun which maximizes the throwing power of the snow gun 10.

To start operation of snow gun 10, first stage 20 is activated by attaching water and air sources (not shown) to water and air inlets 16 and 18, respectively. Water travels through main water line 26 to nucleation block water outlet 28*d* (FIG. 8) and water outlets 40*a* and 40*b* of first stage nozzles 20*a* and 20*b*.

Figure 6A:
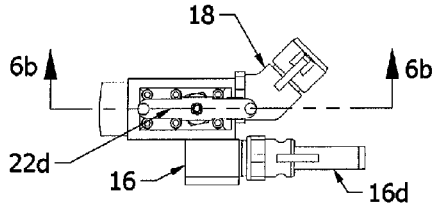
FIG. 6*a* is a reduced side elevational view of FIG. 4.
Figure 6B:
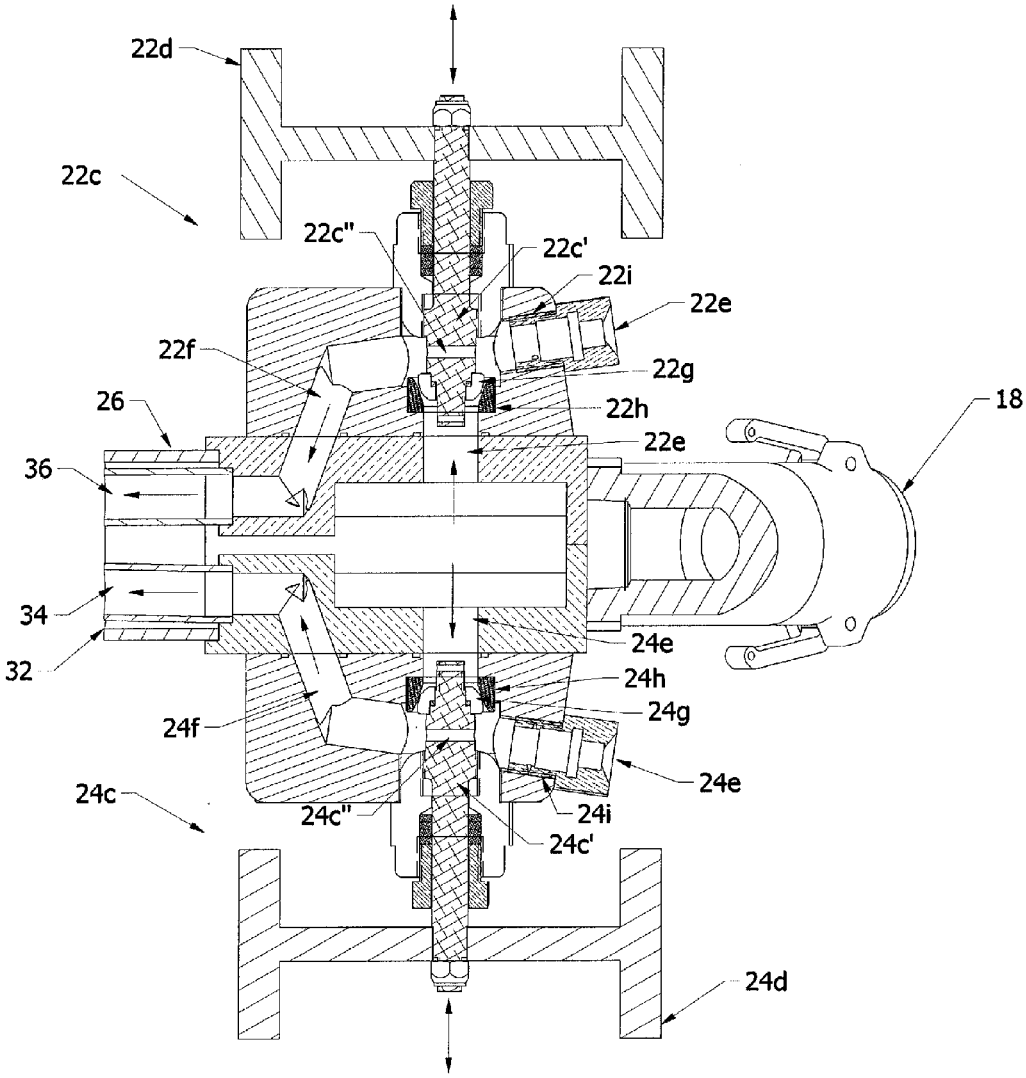
FIG. 6*b* is an enlarged cross-sectional view as taken generally through the line 6*b*-6*b* in FIG. 6*a;*

Operation of second stage 22 is activated by opening second stage water valve assembly 22*c* via handle 22*d*. As seen in FIG. 6*b*, second stage valve body 22*c*' includes a linear aperture 22*c*" with the valve shown in the open condition. Water travels from main water line 32 through passageway 22*e* to reach aperture 22*c*" and flow through line 22*f* which connects to second stage water line 36. To close second stage valve assembly 22*c*, handle 22*d* is turned which causes valve plug 22*g* to seat in valve seat 22*h* which closes off the water supply to second stage valve assembly 22*c*. A drain 22*e* is provided to permit full draining of water from line 36 when second stage valve assembly 22*c* is turned off. Drain 22*e* operates via spring 22*i* which is calibrated to open drain 22*e* upon sensing a pressure below the pressure which is present at valve body 22*c*' when in the open condition. Once the valve is closed, the pressure drops and the spring 22*i* opens the drain 22*e* allowing the water to drain from the second stage line 36 and valve assembly 22*c*. As such, water is not trapped in the line 36 or valve assembly 22*c* as in prior art designs. Any trapped water may freeze and block the line which of course is undesirable in that it will block water flow at a time when it is desired to restart operation of the second stage 22.

Operation of third stage 24 is activated by opening third stage water valve assembly 24*c* via handle 24*d*. Third stage valve assembly 24*c* is essentially identical to second stage valve assembly 22*c* and includes third stage valve 24*c*' having linear aperture 24*c*" shown in the open condition. Water travels from main water line 32 through passageway 24*e* to reach aperture 24*c*" and flow through line 24*f* which connects to third stage water line 34. To close third stage valve assembly 24*c*, handle 24*d* is turned which causes valve plug 24*g* to seat in valve seat 24*h* which closes off the water supply to third stage valve assembly 24*c*. A drain 24*e* is provided to permit full draining of water from line 34 when third stage valve assembly 24*c* is turned off. Drain 24*e* operates via spring 24*i* which is calibrated to open drain 24*e* upon sensing a pressure below the pressure which is present at valve body 24*c*' when in the open condition. Once the valve is closed, the pressure drops and the spring opens the drain allowing the water to drain from the third stage line and valve assembly. As such, water is not trapped in the line or valve as in prior art designs. Any trapped water may freeze and block the line which of course is undesirable in that it will block water flow at a time when it is desired to restart operation of the third stage.

Figure 5A:
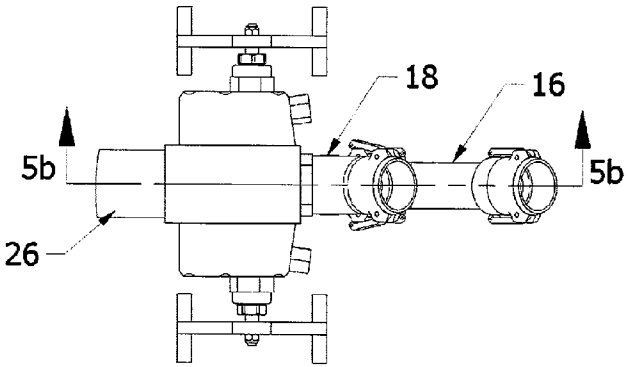
FIG. 5*a* is a reduced top plan view of FIG. 4.
Figure 5B:
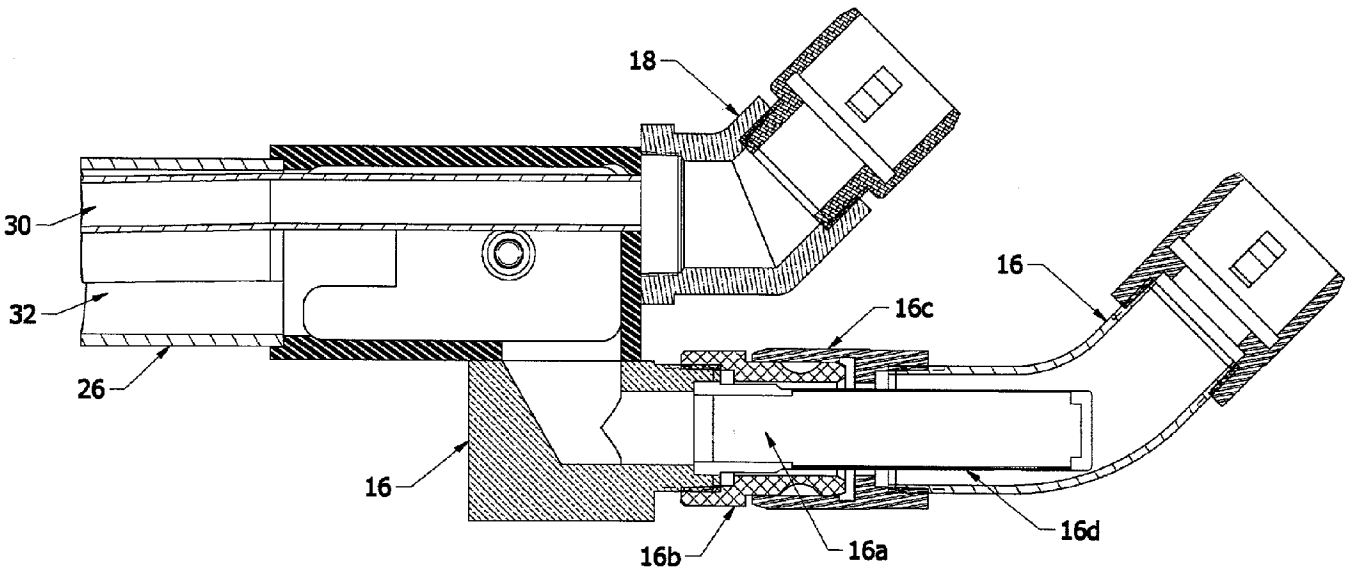
FIG. 5*b* is an enlarged cross-sectional view as taken generally through the line 5*b*-5*b* in FIG. 5*a;*

As seen best in FIG. 5*b*, water inlet 16 may include an optional integral water filter 16*a* designed to remove particulates from the water source. Appropriate connectors 16*b-d* (e.g., friction fit, snap fit, cam lock, etc.) are provided to allow quick and easy access to filter 16*a* for cleaning and replacing. Filter 16*a* is selected to remove large and medium sized particulates. Very small particulates in the water is desirable in that it enhances snow formation as the very small particulates provide a carrier or core upon which the water droplets may attach and form into ice crystals and snow flakes.

There is thus provided an improved low energy snow gun. Although the invention has been described with particular reference to a preferred embodiments thereof, it is understood the invention is not to be limited thereby but rather is defined by the full spirit and scope of the claims which follow.

What is claimed is:

1. A snow gun, comprising:

a. a main water tube having proximal and distal ends with a water and air inlet at said proximal end;

b. at least one nucleator have an air and water outlet located adjacent said water tube distal end;

c. a first stage having an outer cylindrical surface and located adjacent and distally of said nucleator on said water tube; and d. a first unitary nozzle head having at least first and second water outlets arranged in vertical alignment on said outer cylindrical surface of said first stage, said first and second water outlets directed at a vertically divergent angle "H" with respect to one another, and wherein each of said first and second water outlets generates a water droplet stream having a vertical angle "B" of between about 1 to about 15 degrees, and wherein each of said first and second water outlets generates a water droplet stream having a horizontal angle "A" of between about 25 to about 60 degrees.

2. The snow gun according to claim 1 wherein said divergent angle "H" is between about 0 to about 15 degrees.

3. The snow gun according to claim 1 wherein said divergent angle "H" is between about 4 to about 6 degrees.

4. The snow gun according to claim 1 wherein said divergent angle "H" is about 5 degrees.

5. The snow gun according to claim 1 and wherein said first unitary nozzle head is attached to a respective unitary nozzle holder which is attached to said outer cylindrical surface.

6. The snow gun according to claim 1 and further comprising a second unitary nozzle head located on said first stage, said second unitary nozzle head including first and second water outlets arranged in vertical alignment on said first stage at a vertically divergent angle "H" with respect to one another.

7. The snow gun according to claim 6 wherein said first and second nozzles heads are arranged in horizontal alignment and directed at a divergent angle "D".

8. The snow gun according to claim 7 wherein said divergent angle "D" is between about 40 to about 80 degrees.

9. The snow gun according to claim 7 wherein said divergent angle "D" is between about 50 to about 70 degrees.

10. The snow gun according to claim 7 wherein said divergent angle "D" is about 60 degrees.

11. The snow gun according to claim 1 and further comprising a second stage located distally of said first stage, said second stage including a first unitary nozzle head having first and second water outlets arranged in vertical alignment on said second stage and directed at a vertically divergent angle "H" with respect to one another.

12. The snow gun according to claim 11 and further comprising a third stage located between said first and second stages, said third stage including a first unitary nozzle head having first and second water outlets arranged in vertical alignment and directed at a vertically divergent angle "H".

13. The snow gun according to claim 12 wherein each of said first, second and third stages includes first and second unitary nozzles heads each having first and second water outlets, and wherein said first and second unitary nozzles heads on said first, second and third stages are vertically aligned to form first and second columns "C1" and "C2", respectively.

14. The snow gun according to claim 1 wherein each of said first and second water outlets generates a water droplet stream having a horizontal angle "A" of between about 28 to about 40 degrees.

15. The snow gun according to claim 1 wherein each of said first and second water outlets generates a water droplet stream having a horizontal angle "A" of about 34 degrees.

16. The snow gun according to claim 1 wherein each of said first and second water outlets generates a water droplet stream having a vertical angle "B" of between about 6 to about 10 degrees.

17. The snow gun according to claim 1 wherein each of said first and second water outlets generates a water droplet stream having a vertical angle "B" of about 8 degrees.

18. The snow gun according to claim 12 wherein said unitary nozzle heads on said first and third stages are oriented thereon at the same angle "E", and whereby said first water outlet on said first unitary nozzle head on said first stage and said second water outlet on said first unitary nozzle head on said third stage are directed at a converging angle "J".

19. The snow gun according to claim 18 wherein said first unitary nozzle head on said second stage is oriented thereon at an angle "F" which is larger than angle "E".

20. The snow gun according to claim 19 and further comprising a second unitary nozzle head located on each of said first, second and third stages, said second unitary nozzle heads each having first and second water outlets arranged in vertical alignment at a divergent angle "H".

21. The snow gun according to claim 20 wherein each of said first and second unitary nozzle heads on said first, second and third stages are vertically aligned to form first and second columns "C1" and "C2", respectively.

* * * * *